US007685892B2

(12) United States Patent
Hoen

(10) Patent No.: US 7,685,892 B2
(45) Date of Patent: Mar. 30, 2010

(54) METHOD AND A DEVICE FOR MONITORING AN/OR CONTROLLING A LOAD ON A TENSIONED ELONGATED ELEMENT

(75) Inventor: Christopher Hoen, Gjettum (NO)

(73) Assignee: Vetco Gray Scandinavia AS, Sandvika (NO)

( * ) Notice: Subject to any disclaimer, the term of this patent is extended or adjusted under 35 U.S.C. 154(b) by 832 days.

(21) Appl. No.: 10/593,780

(22) PCT Filed: Mar. 22, 2005

(86) PCT No.: PCT/IB2005/000737

§ 371 (c)(1),
(2), (4) Date: Sep. 22, 2006

(87) PCT Pub. No.: WO2005/091712

PCT Pub. Date: Oct. 6, 2005

(65) Prior Publication Data

US 2007/0175639 A1 Aug. 2, 2007

Related U.S. Application Data

(60) Provisional application No. 60/554,989, filed on Mar. 22, 2004.

(51) Int. Cl.
*G01L 5/04* (2006.01)

(52) U.S. Cl. ..... 73/862.391

(58) Field of Classification Search ..... 73/862.391, 73/862.392, 862.393
See application file for complete search history.

(56) References Cited

U.S. PATENT DOCUMENTS

| | | | | |
|---|---|---|---|---|
| 3,722,268 | A | 3/1973 | Crooke et al. | |
| 3,810,081 | A | 5/1974 | Rininger | |
| 4,174,628 | A | 11/1979 | van den Bussche et al. | |
| 4,570,716 | A * | 2/1986 | Genini et al. | 166/346 |
| 5,932,815 | A * | 8/1999 | Dodds | 73/862.393 |
| 6,691,775 | B2 * | 2/2004 | Headworth | 166/77.2 |
| 6,824,330 | B2 * | 11/2004 | Grobe | 405/224.4 |
| 6,834,724 | B2 * | 12/2004 | Headworth | 166/384 |
| 7,000,903 | B2 * | 2/2006 | Piecyk et al. | 254/268 |
| 7,077,603 | B2 * | 7/2006 | Fontaine et al. | 405/168.1 |
| 7,191,837 | B2 * | 3/2007 | Coles | 166/355 |
| 2002/0070033 | A1 * | 6/2002 | Headworth | 166/384 |
| 2002/0074135 | A1 * | 6/2002 | Headworth | 166/384 |
| 2002/0079108 | A1 * | 6/2002 | Headworth | 166/384 |
| 2004/0188094 | A1 * | 9/2004 | Piecyk et al. | 166/344 |

FOREIGN PATENT DOCUMENTS

GB 1241776 A 8/1971

* cited by examiner

*Primary Examiner*—John Fitzgerald
(74) *Attorney, Agent, or Firm*—Venable LLP; Eric J. Franklin

(57) ABSTRACT

A method and device for monitoring and/or controlling a load on a slender, tensioned elongated element extending from a subsea wellhead element to a surface vessel. The tensioned elongated element is arranged so as to be displaced in its longitudinal direction into or out of the subsea wellhead element via an entry at a top end of the latter. The structural behaviour of the wellhead element is measured. The bending moment and/or declination of the tensioned elongated element is estimated in a bottom region adjacent to and/or at the entry upon the basis of the measurement of the structural behaviour of the wellhead element.

21 Claims, 9 Drawing Sheets

METHOD AND A DEVICE FOR MONITORING AN/OR CONTROLLING A LOAD ON A TENSIONED ELONGATED ELEMENT

CROSS-REFERENCE TO RELATED APPLICATIONS

This application claims priority to U.S. provisional patent application 60/554,989 filed 22 Mar. 2004 and is the national phase under 35 U.S.C. § 371 of PCT/IB2005/000737 filed 22 Mar. 2005.

TECHNICAL FIELD

The present invention relates to a method and a device for monitoring and/or controlling a load on a slender, tensioned elongated element extending from a sub-sea wellhead element to a surface vessel, by which the tensioned elongated element is arranged so as to be displaced in its longitudinal direction into or out of the sub-sea wellhead element via an entry at a top end of the latter.

The tensioned elongated element may be any kind of tubing or cable, or even a beam. The wellhead element may be any kind of guiding element, preferably a guiding tube such as a lubricator pipe, that has a bending stiffness that is substantially higher than that of the tensioned elongated element.

In particular, as will be described further in the description of the invention, the tensioned elongated element comprises coiled tubing, and the wellhead element comprises a lubricator means, especially a tube or pipe, via which the coiled tubing is forwarded into the well or wellhead. Accordingly, the invention relates, in particular, to a so-called riserless system in which the coiled tubing runs freely in open sea between the surface vessel and the subsea wellhead.

BACKGROUND OF THE INVENTION

Running coiled tubing in open sea without using a marine riser or a workover riser imposes requirements on the operation of the vessel and the coiled tubing. Because of the limited mechanical strength of the coiled tubing and the subsea stack including the lubricator pipe it is imperative that the equipment be operated within certain predefined limits related to the structural capacities of the equipment. This implies that the following quantities need be controlled or monitored either directly or indirectly:

Top tension of CT (Coiled Tubing)

Declination of the CT when leaving the top injector at the vessel

Bending of the CT when entering the lubricator

Tension of CT when entering the lubricator

The means for keeping control of these quantities are the positioning of the vessel and the applied top tension in the coiled tubing. Three out of these four parameters are readily obtainable through direct measurements: top tension and declination at top injector; and indirect measurements: tension of CT at lubricator, derivable from the top tension and the apparent weight of CT.

Maintaining the structural integrity of the coiled tubing and the subsea stack is essential. The critical loads with respect to structural integrity are related to the entry of the coiled tubing into the lubricator, which will be close to vertical.

When the coiled tubing enters the lubricator it is locally restricted from freely changing shape as a response to the external loading. That is, the coiled tubing must satisfy the boundary conditions given by the entry into the lubricator pipe. Any deviation between the direction of the coiled tubing and the direction of the lubricator pipe will therefore introduce lateral forces between the coiled tubing and the lubricator pipe.

These lateral forces will locally induce bending moments in the coiled tubing. To avoid collapse caused by overbending of the coiled tubing and/or the lubricator pipe these loads must be controlled.

Positioning the vessel such that there is no local bending of the coiled tubing where it enters the lubricator pipe implies that the axial force in the coiled tubing is directed along the lubricator pipe.

Consequently there will be no lateral force acting on the lubricator pipe for this configuration of the coiled tubing. The vessel position that results in this coiled tubing configuration is the optimal one with respect to integrity of the coiled tubing and the subsea stack during operation.

Therefore, it is of importance to know the bending moment and declination of the coiled tubing as it enters the lubricator pipe. However, because the coiled tubing most of the time during operation is either being inserted into the well or being retracted, it is considered impractical to measure the declination or bending moment at lubricator entry directly on the coiled tubing itself.

THE OBJECT OF THE INVENTION

It is an object of the present invention to present a method and a device that solves or makes an important contribution to solving the problems described above. In particular, the invention shall present a method and a device that will enable or facilitate the collection of information about the inclination/declination and/or bending moment of the tensioned elongated element (typically a coiled tubing) so as to monitor and/or control the loads on said element.

A secondary object of the invention is to present a method and a device that guarantees, or at least promotes and facilitates the provision of the vessel position that results in a configuration of the tensioned elongated element that is optimal with respect to integrity of the elongated element and the wellhead element into which the elongated element is introduced during operation.

SUMMARY OF THE INVENTION

The primary object of the invention is achieved by means of the method as initially defined, characterised in that it comprises the steps of:

measuring the structural behaviour of the wellhead element, and estimating the bending moment and/or declination of the tensioned elongated element in a bottom region adjacent to and/or at the entry at the top end of the wellhead element upon basis of the measurement of the structural behaviour of the wellhead element.

Thus, by measuring and monitoring, preferably continuously, the structural behaviour of the wellhead element, which may e.g. comprise bending moment, lateral force magnitudes and directions at the top entry of the wellhead element, or other response quantities of the wellhead element such as e.g. strains, stresses or inclinations, that is related to bending moments and lateral force magnitudes through well-defined mechanical relationships, such as e.g. the Euler-Bernoulli beam equations, information about the bending moment and declination of the tensioned elongated element can be deducted.

The structural behaviour most readily obtainable comprises the bending of the wellhead element, which is also directly related to the bending moment applied via the tensioned elongated element at the entry of the wellhead element. The bending moment of the wellhead element can be obtained by measurement of the inclination (or declination) thereof by means of an inclinometer or by measurement of the strain by means of strain gauges.

According to a preferred embodiment of the invention the measurement of the structural behaviour of the wellhead element comprises the step of measuring the inclination, declination or bending moment of the wellhead element directly or indirectly.

According to a preferred embodiment of the invention the declination/inclination of the top end entry of the wellhead element is measured directly or derived from response measurements related to inclination/declination of the top end entry, e.g. through elementary Euler-Bernoulli beam equations.

The external forces on the wellhead element (lubricator pipe) are caused by the tensioned elongated element (coiled tubing) and the distributed loads caused by the water current. In case the distributed loads on the lubricator pipe can be neglected, the moment in the coiled tubing is given directly from the top angle of the lubricator:

$$M_{CT} = \frac{2EI_L\sqrt{T_{CT}EI_{CT}}}{T_{CT}\cdot l^2 + 2l\sqrt{T_{CT}EI_{CT}}}\cdot\theta_l = \frac{EI_L}{\frac{1}{2}kl^2 + l}\cdot\theta_l$$

As a consequence of the above relation, the estimation of the bottom declination of the tensioned elongated element is based on the following equation:

$$\theta_{CT} = \frac{2EI_L}{T_{CT}\cdot l^2 + 2l\sqrt{T_{CT}\cdot EI_{CT}}}\cdot\theta_l = \frac{1}{\frac{1}{2}(kl)^2 + kl}\cdot\frac{EI_L}{EI_{CT}}\cdot\theta_l$$

wherein $\theta_{CT}$ is the angle of the tensioned elongated element at said entry, $EI_{CT}$ is the bending stiffness of the tensioned elongated element, $EI_L$ is the bending stiffness of the wellhead element, l is the length of the wellhead element (in the vertical direction), $T_{CT}$ is the tension in the longitudinal direction of the tensioned elongated element at said top entry, $$k = \sqrt{\frac{T_{CT}}{EI_{CT}}}$$

is the flexibility factor of the tensioned elongated element, and $\theta_l$ is the angle of the wellhead element at the top entry thereof.

For the general case in which the distributed external loads on the wellhead element cannot be neglected, the method according to the invention is characterised in that two or more response parameters $\theta_{zi}$ (i=1, 2, . . . ) of the wellhead element are measured directly or indirectly at different levels zi above the lower end of the wellhead element, and that the estimation of the bottom declination of the tensioned elongated element is based on relations of the following type:

$$WAr = W\Theta \text{ with } r = \begin{bmatrix} M_{CT} \\ q \end{bmatrix}$$

wherein

W is a suitable non-singular weighting matrix,

Θ is a vector of measurements containing response parameters, such as e.g. declinations/inclinations or strains/stresses or bending moments, A is a coefficient matrix relating $M_{CT}$ and q to the measured response, $M_{CT}$ is the bending moment of the tensioned elongated element, and q is the parameters describing the lateral load distribution on the wellhead element.

The declinations of the tensioned elongated element at lower end (i.e. at entry into wellhead element) are now given by inserting the solution for $M_{CT}$ from this latter equation into the following equation.

$$M_{CT}=\theta_{CT}\sqrt{T_{CT}EI_{CT}}$$

According to a further embodiment of the invention the method also includes measuring the top tension and optionally the top angle of the tensioned elongated element, and estimating a vessel position that minimises the bending of the tensioned elongated element at the wellhead entry upon basis of the measured top tension and optionally top angle in combination with the estimated bottom declination of the tensioned elongated element.

It should be noted that the horizontal reaction force at the lower end of the tensioned elongated element for practical purposes is a sum of two components, namely:

a force proportional to the top end displacement, and a force proportional to a generalised displacement caused by the distributed external loads, e.g. current loads.

For suspended and tensioned coiled tubing exposed to vessel motions and waves, as well as current forces, zero angles can in general not be obtained at the lower and upper end simultaneously. In most cases of current loading there exist no vessel position where the upper and lower angles are both zero. However, there may exist cases where the current has layers of highly diverging directions leading to cancellation effects and reduced coiled tubing response.

The effect on the coiled tubing declinations of a change in vessel position is determined by the following equations:

$$\sin\alpha_{bv} = \frac{K_T}{T_b}u_v$$

$$\sin\alpha_{tv} = \frac{K_T}{T_t}u_v$$

wherein $K_T$ is a stiffness factor defined as $$K_T = \frac{1}{\int_0^L \frac{ds}{T(s)}}$$

where

T(s) is the effective tension distribution along the coiled tubing,

L is the length of the suspended part of the coiled tubing, $u_v$ is the change in vessel position.

The bending moment of the tensioned elongated element at the wellhead element entry will be zero if the lower end declination is zero. In this case the lateral force at the top end of the wellhead element caused by the tensioned elongated element will also be zero.

The declination of the tensioned elongated element close to the wellhead element entry is the sum of an offset related term and a term caused by external lateral loads such as current and waves. The offset related part of the declinations might be computed from the coiled tubing self-weight, buoyancy, top tension and vessel offset as given by the above equations. Conversely, for any given (e.g. measured directly or indirectly) declination the offset required to produce that angle can be estimated.

The top end displacement can be computed from both the above equations. For suspended and tensioned coiled tubing (as a typical example of a tensioned elongated element) with lateral loading the top end displacement computed using the lower end angle would generally be different from the top end displacement computed using the upper end angle.

However, by introducing the constraint that the two estimated top end displacements shall be equal, an equivalent top end displacement or equivalent offset can be computed using a least squares method. By introducing weight factors into the least squares solution, a weighted equivalent offset can be identified. The new vessel position can then be defined in terms of the repositioning vector. The repositioning vector is the vector that will cancel the weighted equivalent offset when applied relative to the present vessel position. The repositioning vector is simply the magnitude of the weighted equivalent offset with the azimuth angle rotated 180°.

Repositioning the vessel using the repositioning vector will give the minimum obtainable declinations at lower and upper end of the coiled tubing for the chosen weight factors, top tension and actual environmental conditions.

The top and bottom coiled tubing declinations are partly controlled by platform position and tension. For initially high tension, changing the position is far more efficient than changing the tension with respect to minimising the declinations. However, at the lower end where the tension may be relatively low compared to the top tension, changing the top tension may be efficient for adjusting the angle towards zero. Whether a reduction or an increase shall be applied, can be determined using the following equation:

$$\alpha_b \cong \sin\alpha_b = \frac{K_T}{T_b}\frac{(u_v + u_{bf})}{\cos\beta_b} = \frac{K_T}{T_b}\frac{v_{bf}}{\sin\beta_b}$$

provided the vessel offset $u_v$ is known. Anyway, change in tension will only influence the part of the declination that is caused by loads from waves, current and coiled tubing apparent weight, not the component caused by top end offset.

According to a preferred embodiment of the invention the method is characterised in that the estimation of the preferred vessel position relative to the present vessel position in a coordinate system with horizontal axes X and Y is based on the following relation:

$$WKx = W\alpha$$

wherein

W is a suitable non-singular weighting matrix,

K is a coefficient matrix relating displacements and angles $$x = \begin{bmatrix} x_e \\ y_e \end{bmatrix}$$

is a vector of the Cartesian coordinates of the weighted equivalent displacements α is a vector of declination sines The optimal vessel position is obtained by moving the vessel a distance:

$$\Delta u = \sqrt{\Delta x^2 + \Delta y^2}$$

in direction $$\psi = a\tan\left(\frac{\Delta y}{\Delta x}\right)$$

where ψ is measured in radians, anti-clockwise relative to the X-axis of the measurement co-ordinate system and with $$\begin{bmatrix} \Delta x \\ \Delta y \end{bmatrix} = -\begin{bmatrix} x_e \\ y_e \end{bmatrix}$$

For further understanding of the above equations, reference is made to the following detailed description, supported by the annexed drawings.

The object of the invention is also achieved by means of a device as initially defined, characterised in that it comprises:

means for measuring the structural behaviour of the wellhead element, and means for estimating the bending moment and/or declination of the tensioned elongated element in a bottom region adjacent to and/or at the entry at the top end of the wellhead element upon basis of the measurement of the structural behaviour of the wellhead element.

BRIEF DESCRIPTION OF THE DRAWINGS

The invention will be further described by way of example with regard to the following drawings, on which.

DETAILED DESCRIPTION OF THE INVENTION

Figure 1:
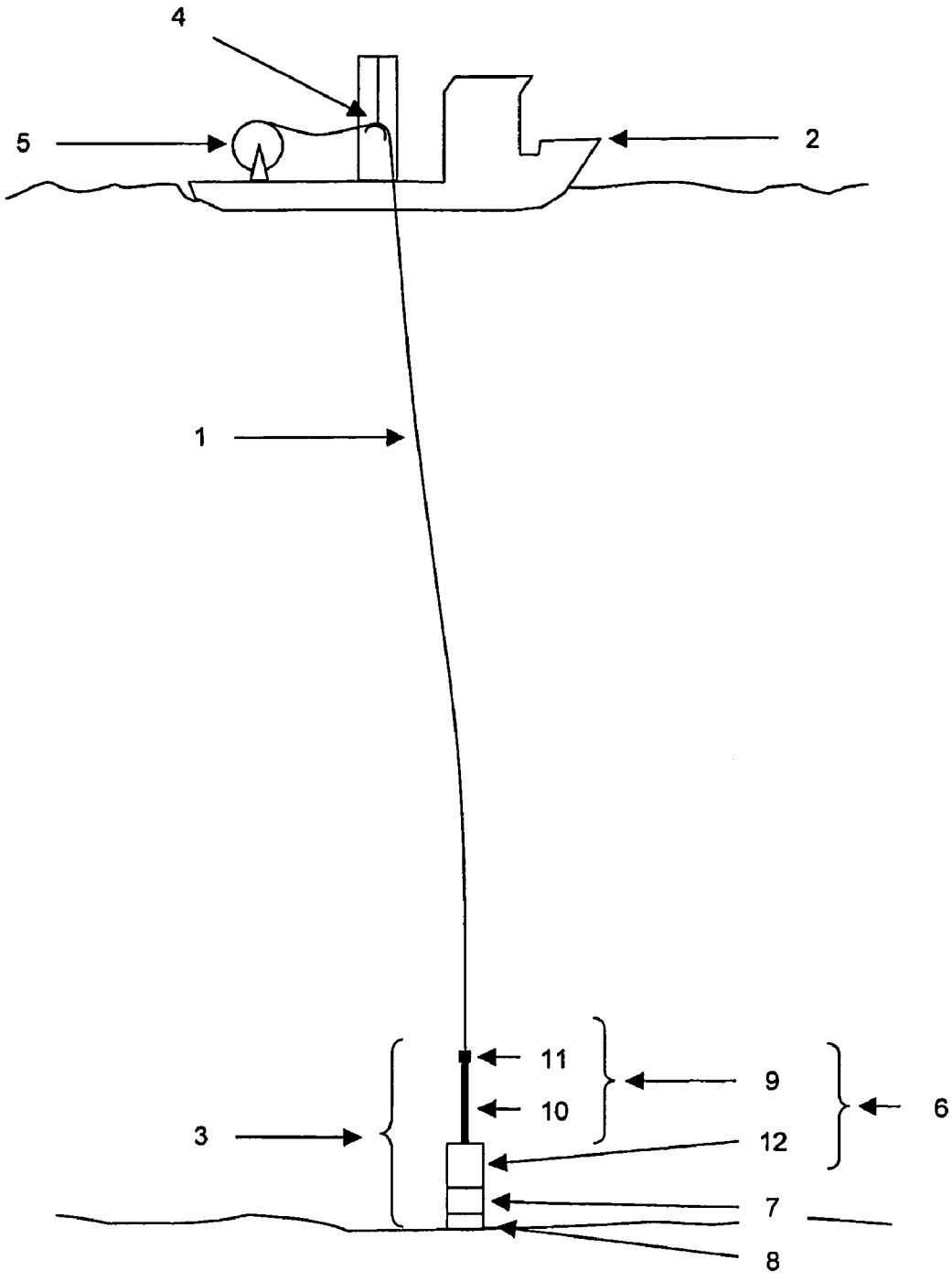
FIG. 1 is a schematic view of a system for intervention of a subsea well including a dynamically positioned intervention vessel, a coiled tubing and a wellhead assembly according to an embodiment of the invention.

FIG. 1 shows a preferred system in which the inventive device for monitoring and/or controlling a load on a tensioned coiled tubing 1 is to be applied. A system corresponding to FIG. 1 has also been described in the International application no. PCT/IB2003/003084 (WO 2004/003338 A1), which hereby is included by reference in its entirety. The coiled tubing 1 extends from a dynamically positioned intervention vessel 2 through a water body mass in open sea down to a subsea wellhead assembly 3. For simplicity, FIG. 1 shows only the major components of the system focusing on the structural load carrying parts: coiled tubing 1, lubricator package 6 etc.

The system comprises the following main components: a coiled tubing surface system including a heave compensated coiled tubing suspension and tensioning system 4 and a coiled tubing reel 5 for feeding out/retracting coiled tubing; a surface handling and motion compensation system (not shown) for running and retrieval of equipment/packages, handling and sea fastening of equipment/packages on vessel deck, and for compensation of surface coiled tubing motions during operation; a subsea lubricator system including the coiled tubing lubricator package 6, a coiled tubing subsea injector package 7 and a well barrier package 8; and a control/monitor system (not shown) including all necessary equipment for running and controlling/monitoring the system.

The subsea wellhead assembly 3 is preferably connected via a Christmas tree adapter package to a Christmas tree of the wellhead (not shown) located at the seabed. The coiled tubing lubricator package 6 comprises a lubricator pipe element 9 with a lubricator pipe 10, an upper end section 11 adapted to be fitted to the lubricator pipe 10, and a lubricator support frame 12. The coiled tubing injector package 7 comprises driving means, preferably extending in the axial direction of said package, between which the lubricator pipe element 9 is forwarded/retracted during operation.

Coiled tubing 1 suspended in tension from a surface vessel 2 to the wellhead carries transverse loads in the same way as a rope or a cable, i.e. the lateral loads are carried by tension in the coiled tubing. The axial force in long suspended coiled tubing will therefore always be directed along the tangent to the tubing. Thus, there will be a change in direction of the axial force along the coiled tubing as the shape of the suspended coiled tubing deviates from a straight line. This change in direction of the axial force makes it possible for the coiled tubing to carry large lateral loads, being it distributed, concentrated or in combination.

The lubricator pipe 10 and the vessel 2 support the transverse loads on the coiled tubing caused by e.g. current. The magnitude of the lateral load supported by the lubricator pipe and the vessel respectively, depends on the position of the vessel relative to the wellhead and the magnitude of the current force along the coiled tubing.

Figure 2:
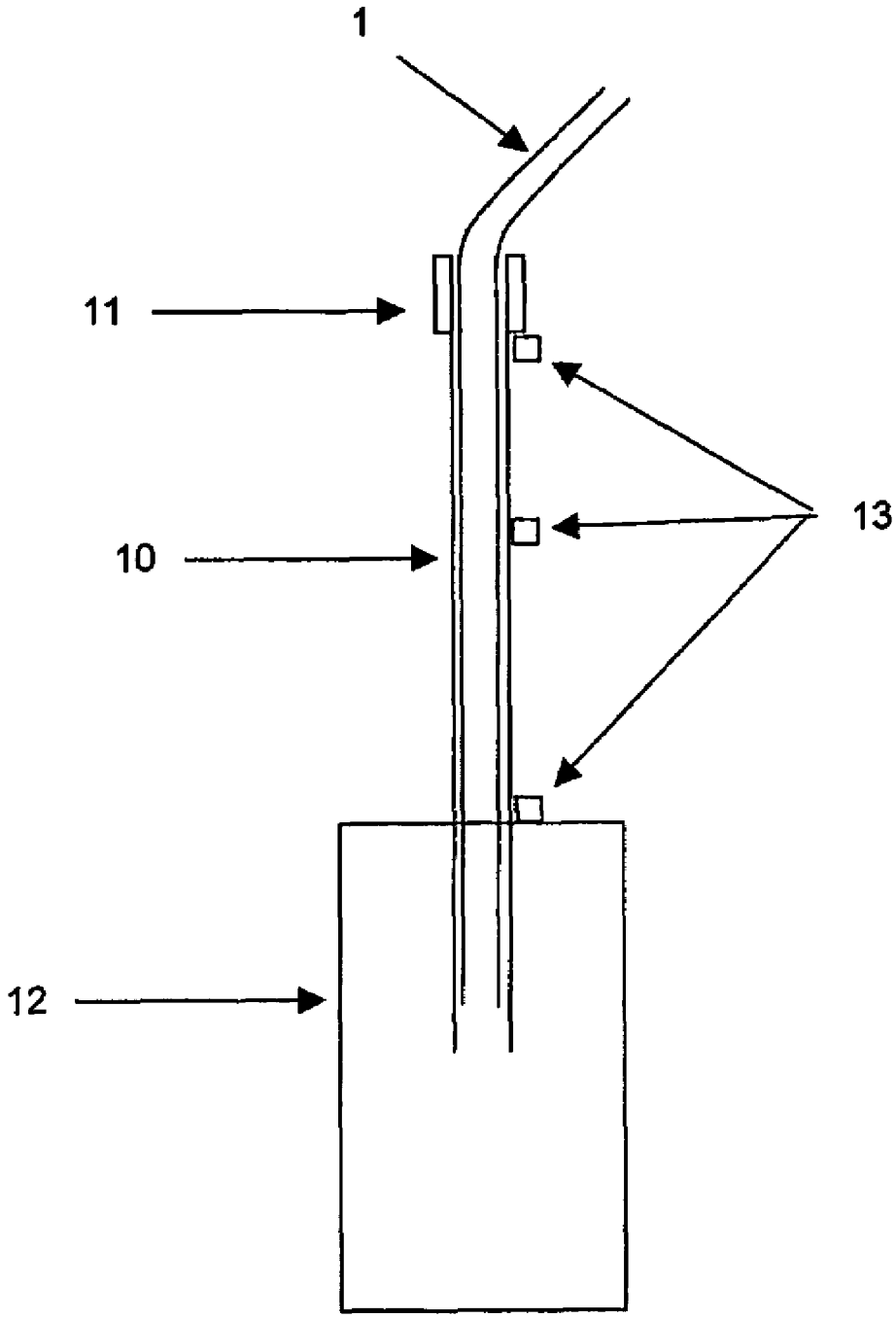
FIG. 2 is a schematic side view illustrating a preferred embodiment of typical placement of sensors (e.g. biaxial inclinometers) according to the invention.
Figure 3:
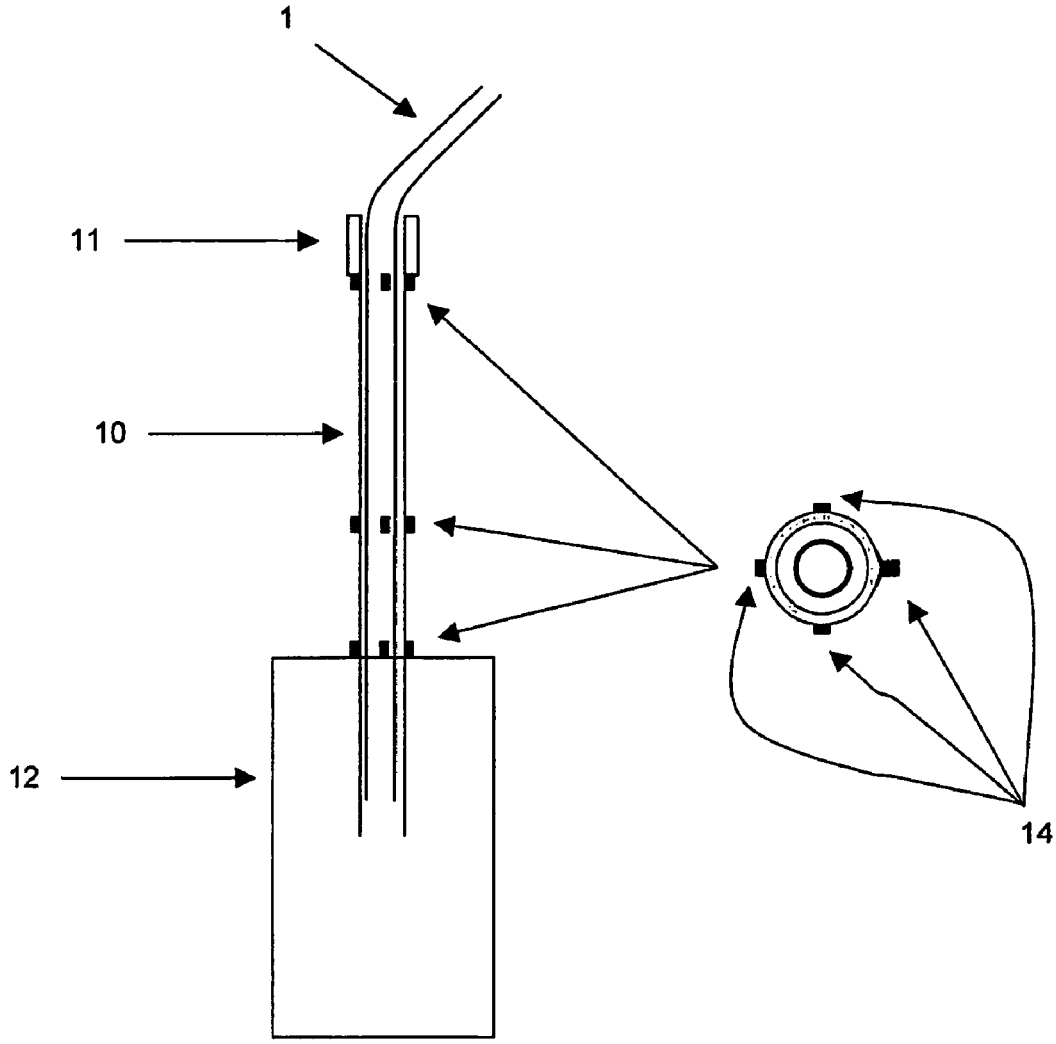
FIG. 3 is a schematic side view illustrating another preferred embodiment of typical placement of sensors (e.g. strain gauges) according to the invention.

FIGS. 2 and 3 illustrate two different sensor placements and sensor types for measuring the structural behaviour of the lubricator pipe element 9 according to preferred embodiments of the present invention.

FIG. 2 illustrates an embodiment that includes sensors of the type bi-axial inclinometers 13 for measuring the inclinations/declinations of the lubricator pipe element 9. The inclinometers 13 are placed at the lubricator pipe 10 on three different levels: at the upper part 11, at the middle and at the lower part of the lubricator pipe 10. The inclinations/declinations do not necessarily need to be measured at the upper part 11 of the lubricator pipe 10. This is, however, a preferred position as seen from a measurement point of view. Further, three inclinometers 13 as shown in FIG. 2 are preferred. However, additional inclinometer(s) 13 placed on additional level(s) will naturally enhance the estimation accuracy of the measurements.

FIG. 3 illustrates an embodiment that includes sensors of the type strain gauges 14 for measuring (directly or indirectly) strains/stresses/moments of the lubricator pipe element 9. As shown in FIG. 3, four strain gauges 14 are placed equally distributed around the circumference at three different levels: at the upper part 11 and at the lower part of the lubricator pipe 10. Further, four strain gauges 14 as shown in FIG. 3 are preferred. However, additional strain gauges 14 placed on the same level(s) and/or additional level(s) will naturally enhance the estimation accuracy of the measurements.

Accordingly in view of the above, the present invention may include one or more sensors. Typically, the sensors 13 or 14 are placed about lubricator pipe 10. Among the types of sensors that may be utilized are inclinometers and/or strain gauges. One type of inclinometer that may be utilized is a bi-axial inclinometer. Other types of sensors may also be utilized in addition or alternatively. One or more sensor types may be utilized simultaneously.

The sensors may be placed anywhere they can sense what they are intended to measure. Some embodiments may include sensors arranged at different levels. One or more levels may be included. For example, the embodiments shown in FIGS. 2 and 3 include sensors arranged at three levels. However, only two levels could be used, or more than three levels. One or more of the same type or different sensor types could be arranged at each level. For example, only three sensors 14 or more than four sensors 14 could be arranged at each level in the embodiment shown in FIG. 3. The sensors could also be arranged on structures other than the lubricator pipe 10. In reality, any combination of sensor type and placement could be utilized that provides the desired data.

Figure 4:
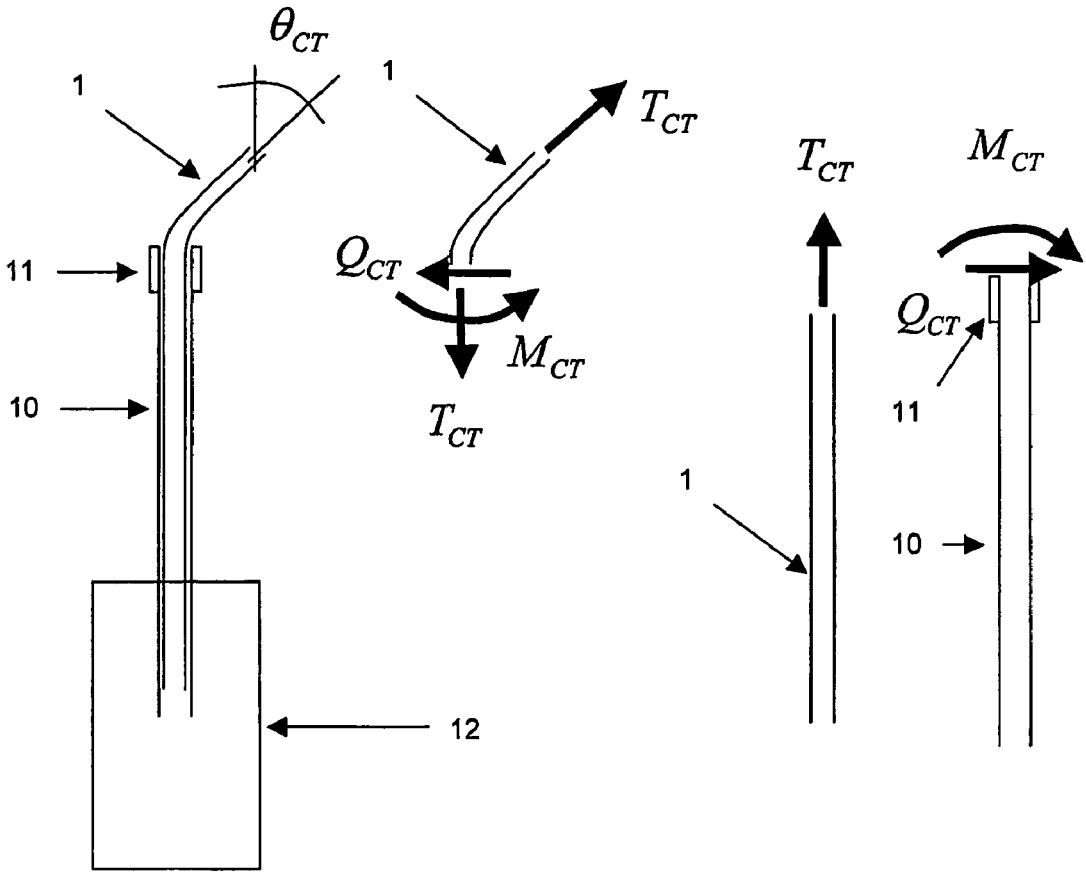
FIG. 4 is a schematic diagram showing the principle of load transfer from coiled tubing to lubricator pipe at top of lubricator pipe.

FIG. 4 is a schematic diagram showing the principle of load transfer from tensioned coiled tubing 1 to lubricator pipe 10 at top entry 11 of the lubricator pipe 10.

The angle $\theta_{CT}$ of the coiled tubing 1 is obtained from the moment $M_{CT}$, tension $T_{CT}$ and bending stiffness $EI_{CT}$ as follows:

$$\theta_{CT}=M_{CT}/\sqrt{T_{CT}EI_{CT}}$$

The external forces, i.e. the moment $M_{CT}$ and the shear force $Q_{CT}$, on the lubricator pipe 10 are caused by the coiled tubing 1 and the distributed loads caused by e.g. water currents. In case the distributed loads on the lubricator pipe 10 can be neglected, the moment in the coiled tubing 1 is given directly from the top angle of the lubricator pipe 10:

$$M_{CT} = \frac{2EI_L\sqrt{T_{CT}EI_{CT}}}{T_{CT}\cdot l^2 + 2l\sqrt{T_{CT}EI_{CT}}}\cdot\theta_l = \frac{EI_L}{\frac{1}{2}kl^2 + l}\cdot\theta_l$$

As a consequence of the above relation, the estimation of the bottom declination, $\theta_{CT}$, of the coiled tubing 1 is based on the following equation:

$$\theta_{CT} = \frac{2EI_L}{T_{CT}\cdot l^2 + 2l\sqrt{T_{CT}\cdot EI_{CT}}}\cdot\theta_l = \frac{1}{\frac{1}{2}(kl)^2 + kl}\cdot\frac{EI_L}{EI_{CT}}\cdot\theta_l$$

wherein $\theta_{CT}$ is the angle of the coiled tubing 1 at the top entry 11, $EI_{CT}$ is the bending stiffness of the coiled tubing 1, $EI_L$ is the bending stiffness of the lubricator pipe 10, l is the length of the lubricator pipe 10 (in its axial direction), $T_{CT}$ is the tension in the longitudinal direction of the tensioned coiled tubing 1 at the top entry 11, $$k = \sqrt{\frac{T_{CT}}{EI_{CT}}}$$

is the flexibility factor of the coiled tubing 1 and $\theta_l$ is the angle of the lubricator pipe 10 at the top entry 11 thereof.

Figure 5:
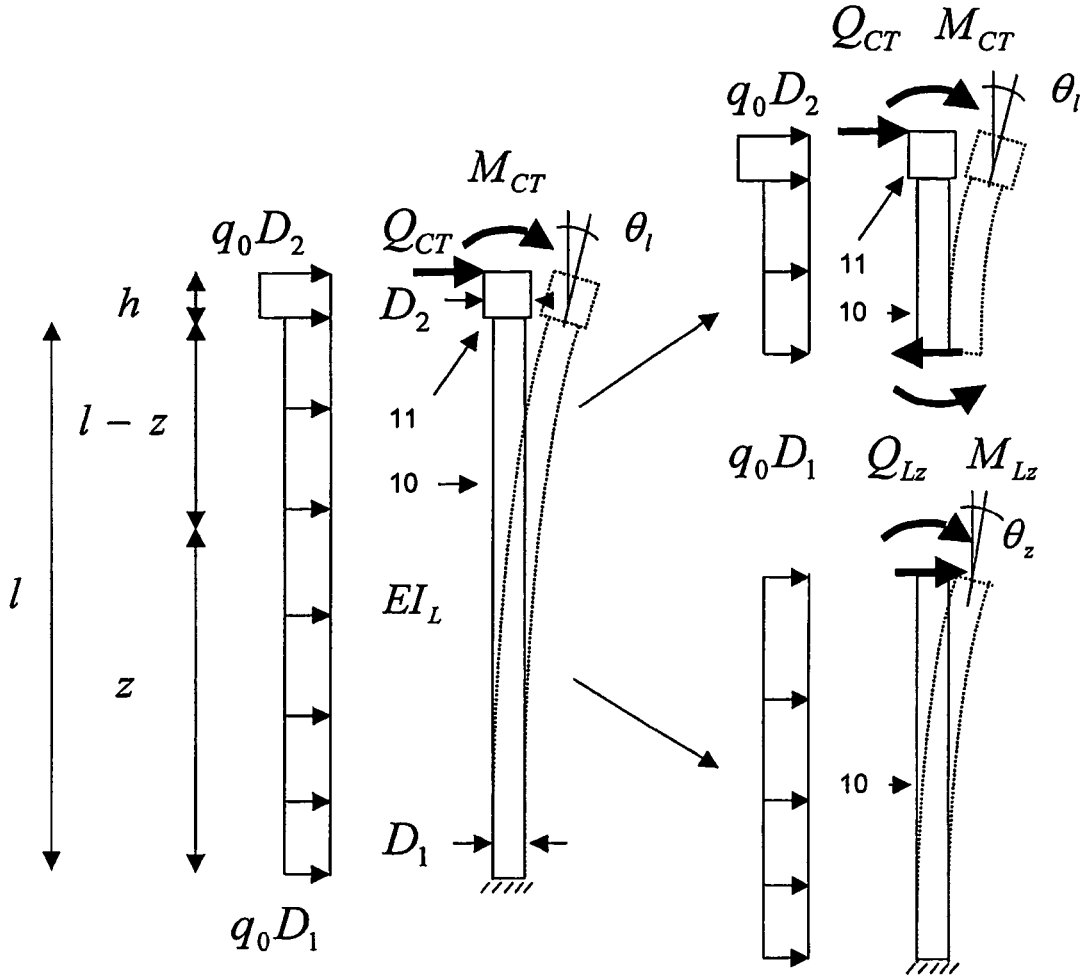
FIG. 5 is a schematic diagram showing the lubricator pipe analysis model defining the parameters involved in the developed mathematical model for estimating coiled tubing bending moment from measured lubricator pipe behaviour.

FIG. 5 is a schematic diagram showing the lubricator pipe 10 analysis model defining the parameters involved in the developed mathematical model for estimating coiled tubing 1 bending moment from measured lubricator pipe 10 behaviour.

For the general case in which the distributed external loads on the lubricator pipe 10 cannot be neglected, two or more response parameters $\theta_{zi}$ (i=1, 2, . . . ) of the lubricator pipe 10 are measured directly or indirectly at different levels zi above the lower end of the lubricator pipe 10, and that the estimation of the bottom declination of the coiled tubing 1 is based on relations of the following type:

$$WAr = W\Theta \text{ with } r = \begin{bmatrix} M_{CT} \\ q \end{bmatrix}$$

wherein

W is a suitable non-singular weighting matrix,

Θ is a vector of measurements containing response parameters, such as e.g. declinations/inclinations or strains/stresses or bending moments, A is a coefficient matrix relating $M_{CT}$ and q to the measured response, $M_{CT}$ is the bending moment of the tensioned coiled tubing 1 and q is the parameters describing the lateral load distribution on the lubricator pipe 10.

This is further exemplified for two measurement positions z=z1 and z=z2 with measurement of declinations $\theta_{z1}$ and $\theta_{z2}$ and a weighting matrix equal the identity matrix:

$$\begin{bmatrix} \theta_{z_1} \\ \theta_{z_2} \end{bmatrix}_j = \begin{bmatrix} a & b \\ c & d \end{bmatrix}_j \cdot \begin{bmatrix} M_{CT} \\ q_0 \end{bmatrix}_j,\ j = X, Y$$

wherein:

$$a = \left\{\left(l + h - \frac{z_1}{2}\right)\cdot k + 1\right\}\frac{z_1}{EI_L}$$

$$b = \left\{\left(l^2 - z_1 l + \frac{z_1^2}{3}\right)\cdot D_1 + h\cdot(h + 2l - z_1)\cdot D_2\right\}\frac{z_1}{2EI_L}$$

$$c = \left\{\left(l + h - \frac{z_2}{2}\right)\cdot k + 1\right\}\frac{z_2}{EI_L}$$

$$d = \left\{\left(l^2 - z_2 l + \frac{z_2^2}{3}\right)\cdot D_1 + h\cdot(h + 2l - z_2)\cdot D_2\right\}\frac{z_2}{2EI_L}$$

and wherein:

$EI_L$ is the bending stiffness of the lubricator pipe 10, $D_1$ is the diameter of lubricator pipe 10, $D_2$ is the diameter of upper end section 11 of the lubricator pipe 10, l is the length of lubricator pipe 10, h is the length of the upper end section 11, and $q_0$ is the lateral loading for unit diameter pipe.

The solutions of these 2×2 systems are well known:

$$\begin{bmatrix} M_{CT} \\ q_0 \end{bmatrix}_j = \frac{1}{ad - bc}\begin{bmatrix} d & -b \\ -c & a \end{bmatrix}_j \cdot \begin{bmatrix} \theta_{z_1} \\ \theta_{z_2} \end{bmatrix},\ j = X, Y$$

The declinations of the coiled tubing 1 at lower end (i.e. at entry into lubricator pipe element 9) are now given by inserting the solution for $M_{CT}$ from this latter equation as given in the equation defining the relation between $M_{CT}$ and $\theta_{CT}$ defined in connection with the description of FIG. 4.

Figure 6:
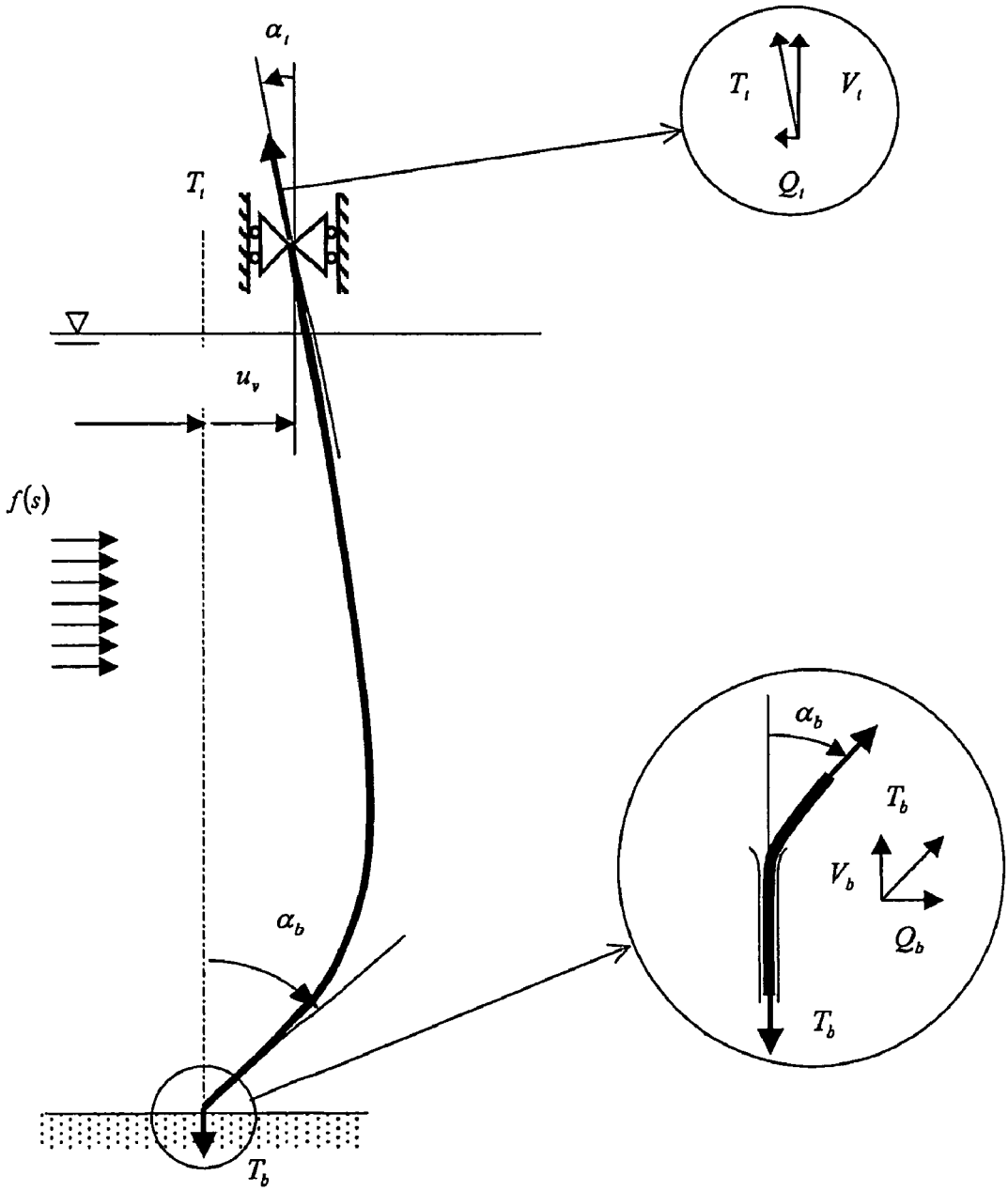
FIG. 6 is a schematic diagram showing coiled tubing in water body mass, vessel, and relevant parameters to be applied in the mathematical modelling of the system.

FIG. 6 is a schematic diagram showing tensioned coiled tubing 1 in water body mass, vessel, and relevant parameters to be applied in the mathematical modelling of the system.

According to this embodiment of the invention, the method for monitoring and/or controlling loads on the coiled tubing 1 also includes:

measuring the top tension $T_t$ and optionally the top angle $\alpha_t$ of the coiled tubing 1, and estimating a vessel position that minimises the bending of the coiled tubing 1 at the entry to the lubricator pipe element 9 upon basis of the measured top tension and optionally top angle in combination with the estimated bottom declination $\alpha_b = \theta_{CT}$ of the coiled tubing 1.

It should be noted that the horizontal reaction force $Q_b$ at the lower end of the coiled tubing 1 for practical purposes is a sum of two components, namely:

a force proportional to the top end displacement $u_v$, and a force proportional to a generalised displacement caused by the distributed external loads, e.g. current loads, as denoted by f(s) in FIG. 6.

For suspended and tensioned coiled tubing exposed to vessel motions and wave, as well as current forces, zero angles can in general not be obtained at the lower and upper end simultaneously. In most cases of current loading there exist no vessel positions where the upper and lower angles are both zero. However, cases may exist where the current has layers of highly diverging directions leading to cancellation effects and reduced coiled tubing response.

The effect on the coiled tubing declinations of a change in vessel position is determined by the following equations:

$$\sin\alpha_{bv} = \frac{K_T}{T_b} u_v$$

$$\sin\alpha_{tv} = \frac{K_T}{T_t} u_v$$

wherein $u_v$ is the change in position of the vessel 2, $T_b$ is the effective tension at the bottom end of the coiled tubing 1, $T_t$ is the effective tension at the top end of the coiled tubing 1, and $K_T$ is a stiffness factor defined as $$K_T = \frac{1}{\int_0^L \frac{ds}{T(s)}}$$

where

Figure 7:
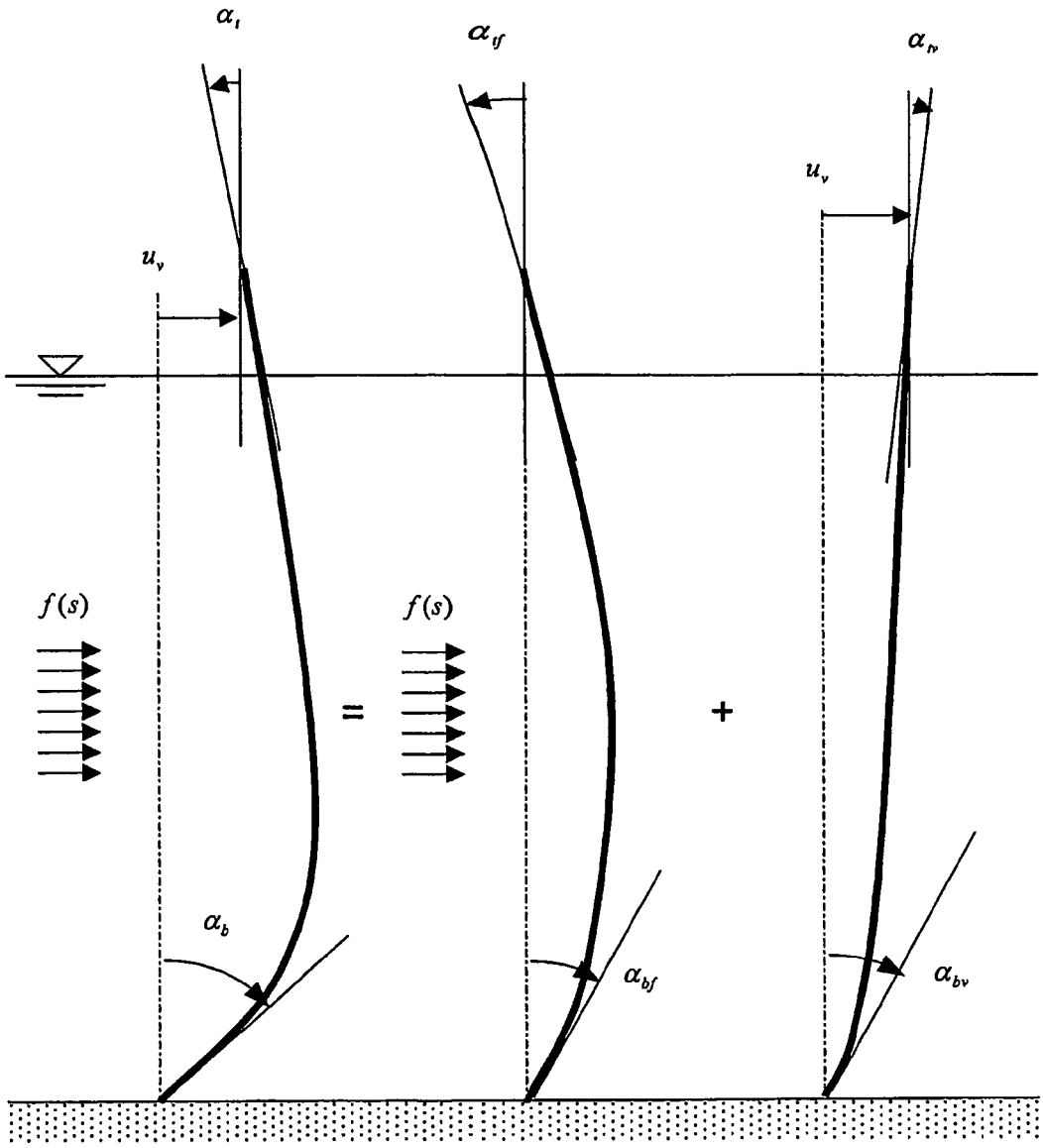
FIG. 7 is a schematic diagram showing the principle of superposition applied to suspended and tensioned coiled tubing exposed to top end offset and lateral distributed loads.

T(s) is the effective tension distribution along the coiled tubing 1,

L is the length of the suspended part of the coiled tubing 1,

FIG. 7 is a schematic diagram showing the principle of superposition applied to suspended and tensioned coiled tubing exposed to top end offset and lateral distributed loads.

The declinations of the coiled tubing 1 close to the lubricator pipe 10 entry, $\alpha_b$, and at the top end, $\alpha_t$, are each the sum of an offset related term, $\alpha_{bv}$, $\alpha_{tv}$, and a term caused by external lateral loads such as current and waves, $\alpha_{bf}$, $\alpha_{tf}$ (the wave and current forces per unit length is generally denoted as f(s) in FIG. 7). The offset related part of the declinations, $\alpha_{bv}$, $\alpha_{tv}$, might be computed from the coiled tubing self-weight, buoyancy, top tension and vessel offset as given by the above equations. Conversely, for any given (e.g. measured directly or indirectly) declination the offset required to produce that angle can be estimated. This estimated offset is called the equivalent offset.

Figure 8:
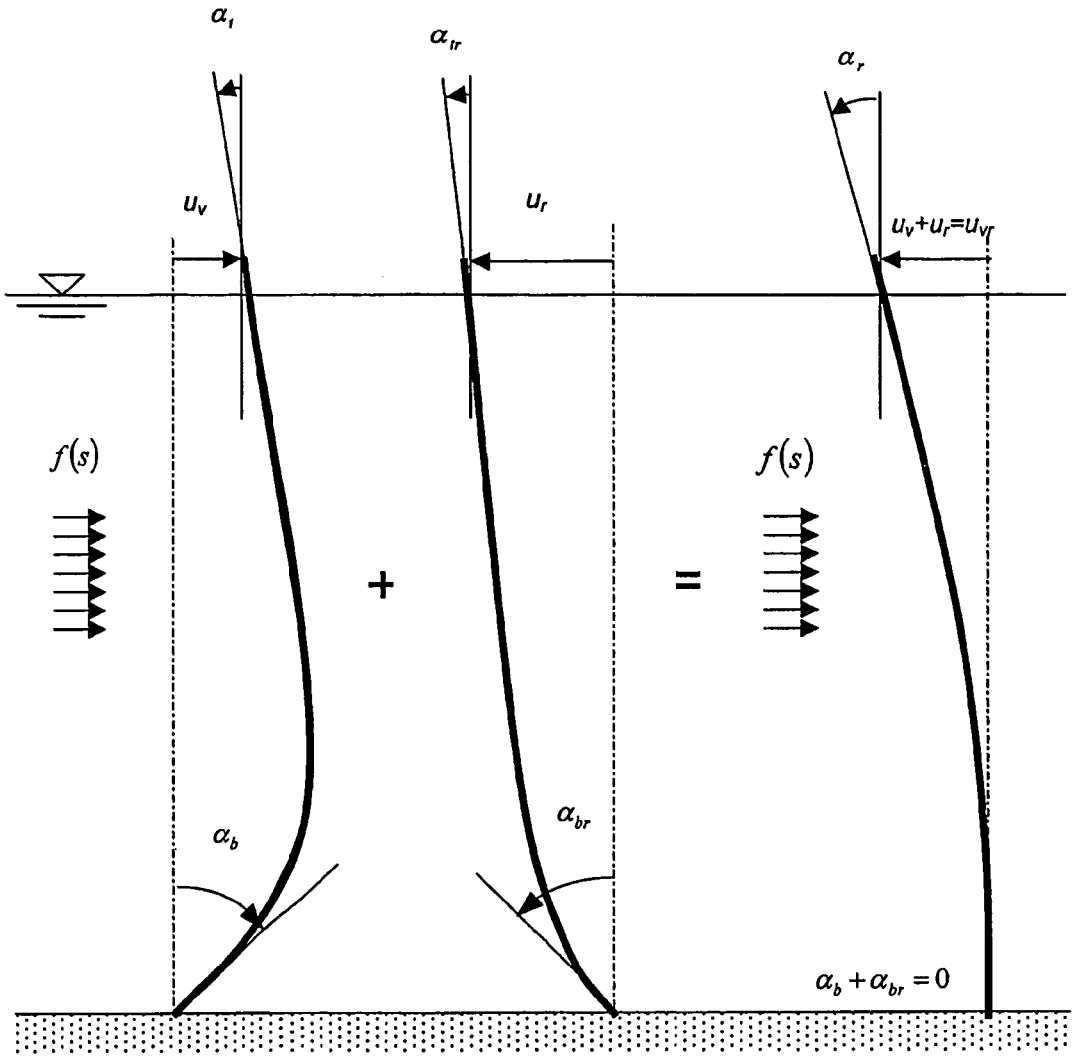
FIG. 8 is a schematic diagram showing application of the superposition principle to obtain a desired lower end angle, i.e. the repositioning principle.

FIG. 8 is a schematic diagram showing application of the superposition principle to obtain the desired lower end angle, i.e. the repositioning principle.

The bending moment of the coiled tubing 1 at the lubricator pipe element entry will be zero if the lower end declination, $\alpha_b$, is zero. In this case the lateral force at the top end of the lubricator pipe element 9 caused by the coiled tubing 1 will also be zero.

The optimal vessel position can be defined in terms of the re-positioning vector, $u_r$, and the equivalent offset, $u_e$, computed using the lower end angle and the relevant equation defined above relating lower end angle and top end displacement. The repositioning vector is obtained as the equivalent offset vector rotated 180°.

Repositioning the vessel using the estimated repositioning vector will give the minimum declinations at lower end of the coiled tubing for the current top tension and actual environmental conditions.

Figure 9:
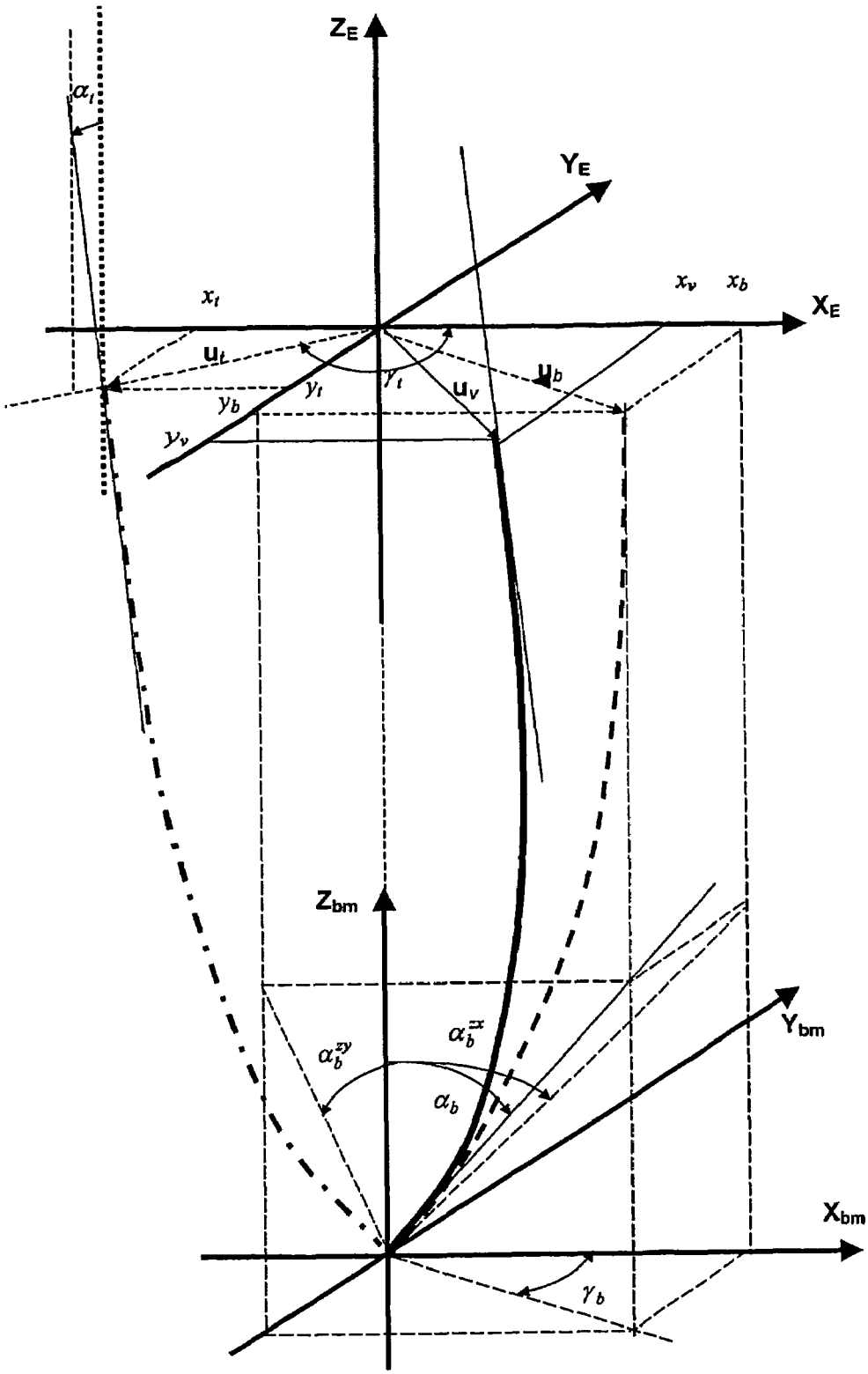
FIG. 9 is a schematic diagram indicating how to obtain the lower end and top end angles respectively obtained for laterally loaded coiled tubing by applying top end displacement when no lateral load is present.

FIG. 9 is a schematic diagram indicating how to obtain the lower end and top end angles respectively obtained for laterally loaded coiled tubing 1 by applying top end displacement when no lateral load is present.

The top end displacement, $U_b$ and $u_t$, can be computed from each of the above equations respectively. For suspended and tensioned coiled tubing with lateral loading the top end displacement, $u_b$, computed using the lower end angle, $\alpha_b$, would generally be different from the top end displacement, $u_t$, computed using the upper end angle, $\alpha_t$.

However, by introducing the constraint that the two estimated top end displacements shall be equal, an equivalent top end displacement or equivalent offset can be computed using a least squares method. By introducing weight factors into the least squares solution, a weighted equivalent offset can be identified. The new vessel position can then be defined in terms of the repositioning vector. The repositioning vector is the vector that will cancel the weighted equivalent offset when applied relative to the present vessel position. The repositioning vector is simply the magnitude of the weighted equivalent offset with the azimuth angle rotated 180°.

Repositioning the vessel using the repositioning vector will give the minimum obtainable declinations at lower and upper end of the coiled tubing for the chosen weight factors, top tension and actual environmental conditions.

According to a preferred embodiment of the invention, the estimation of the preferred vessel position relative to the present vessel position in a coordinate system with horizontal axes X and Y is based on the following relation:

$$W\begin{bmatrix} \frac{K_T}{T_b} & 0 \\ 0 & -\frac{K_T}{T_b} \\ \frac{K_T}{T_t} & 0 \\ 0 & -\frac{K_T}{T_t} \end{bmatrix}\begin{bmatrix} x_e \\ y_e \end{bmatrix} = W\begin{bmatrix} \sin\alpha_{mb}^{zx} \\ \sin\alpha_{mb}^{zy} \\ \sin\alpha_{mt}^{zx} \\ \sin\alpha_{mt}^{zy} \end{bmatrix}$$

wherein

W is a suitable non-singular weighting matrix, and $$K_T = \frac{1}{\int_0^L \frac{ds}{T(s)}}$$

and

-continued $$\sin\alpha_{mb}^{zx} \cong \sin\alpha_{mb}\cos(\beta_{mb}-\gamma_{mb}) = \frac{K_T}{T_b} = u_v \cdot \cos(\beta_{mb}-\gamma_{mb}) = \frac{K_T}{T_b}x_b$$

$$\sin\alpha_{mb}^{zy} \cong \sin\alpha_{mb}\sin(\beta_{mb}-\gamma_{mb}) = -\frac{K_T}{T_b}u_v \cdot \sin(\beta_{mb}-\gamma_{mb}) = -\frac{K_t}{T_b}y_b$$

$$\sin\alpha_{mt}^{zx} \cong \sin\alpha_{mt}\cos(\beta_{mt}-\gamma_{mt}) = \frac{K_T}{T_t}u_v \cdot \cos(\beta_{mt}-\gamma_{mt}) = \frac{K_T}{T_t}x_t$$

$$\sin\alpha_{mt}^{zy} \cong \sin\alpha_{mt}\sin(\beta_{mt}-\gamma_{mt}) = -\frac{K_T}{T_t}u_v \cdot \sin(\beta_{mt}-\gamma_{mt}) = -\frac{K_T}{T_t}y_t$$

where $x_b$, $y_b$, $x_t$, $y_t$ are the Cartesian coordinates of the offset estimates related to the simultaneously measured (directly or indirectly) lower and upper end declination respectively given in the Xk-Yk-Zk, (k=mb, mt), measurement interpretation coordinate systems, and given the constraint that:

$$xe=w_{xb}\cdot x_b=w_{xt}\cdot x_t$$

$$y_e w_{yb}\cdot y_b=w_{yt}\cdot y_t$$

where $w_{xb}$, $w_{yb}$, $w_{xt}$, $w_{yt}$ are weights related to the elements of the non-singular weighting matrix W.

The optimal vessel position is obtained by moving the vessel a distance:

$$\Delta u=\sqrt{\Delta x^2+\Delta y^2}$$

in direction $$\psi = \operatorname{atan}\left(\frac{\Delta y}{\Delta x}\right)$$

where ψ is measured in radians, anti-clockwise relative to the X-axis of the measurement co-ordinate system and with $$\begin{bmatrix}\Delta x\\ \Delta y\end{bmatrix} = -\begin{bmatrix}x_e\\ y_e\end{bmatrix}$$

The bottom and top end coiled tubing declinations, $\alpha_b$, $\alpha_t$, are partly controlled by platform position and tension. For initially high tension, changing the position is far more efficient than changing the tension with respect to minimising the declinations. However, at the lower end where the tension may be relatively low compared to the top tension, changing the top tension may be efficient for adjusting the angle towards zero. Whether a reduction or an increase shall be applied, can be determined using the following equation:

$$\alpha_b \cong \sin\alpha_b = \frac{K_T}{T_b}\frac{(u_v+u_{bf})}{\cos\beta_b} = \frac{K_T}{T_b}\frac{v_{bf}}{\sin\beta_b}$$

provided the vessel offset $u_v$ is known. Anyway, change in tension will only influence the part of the declination that is caused by loads from waves, current and coiled tubing apparent weight, not the component caused by top end offset.

The invention is of course not in any way restricted to the preferred embodiments described above. On the contrary, many possibilities to modifications thereof will be apparent to a person with ordinary skill in the art without departing from the basic idea of the invention such as defined in the appended claims.

The invention claimed is:

1. A method of monitoring a load on a slender, tensioned elongated element extending from a subsea wellhead element to a surface vessel, by which the tensioned elongated element is arranged so as to be displaced in its longitudinal direction into or out of the subsea wellhead element via an entry at a top end of the latter, the method comprising:

measuring the structural behaviour of the wellhead element, and estimating the bending moment and/or declination of the tensioned elongated element in a bottom region adjacent to and/or at said entry upon basis of the measurement of the structural behaviour of the wellhead element.

2. The method according to claim 1, wherein the measurement and estimation are used to control the load on the tensioned elongated element.

3. The method according to claim 1, wherein the estimation of the bottom declination of the tensioned elongated element is based on the following equation:

$$\theta_{CT} = \frac{2EI_L}{T_{CT}\cdot l^2 + 2l\sqrt{T_{CT}\cdot EI_{CT}}}\cdot\theta_l = \frac{1}{\frac{1}{2}(kl)^2+kl}\cdot\frac{EI_L}{EI_{CT}}\theta_l$$

wherein $\theta_{CT}$ is the angle of the tensioned elongated element at said entry, $EI_{CT}$ is the bending stiffness of the tensioned elongated element, $EI_L$ is the bending stiffness of the wellhead element, l is the length of the tensioned elongated element, $T_{CT}$ is the tension in the longitudinal direction of the tensioned elongated element at said top entry, $$k = \sqrt{\frac{T_{CT}}{EI_{CT}}}$$

is the flexibility factor of the tensioned elongated element and $\theta_l$ is the angle of the wellhead element at the top entry thereof, measured directly or indirectly.

4. The method according to claim 1, wherein two or more response parameters $\theta_{zi}$ of the wellhead element are measured at different levels zi above the lower end of the wellhead element, and that the estimation of the bottom declination of the tensioned elongated element is based on relations of the following type $$WAr = W\Theta \text{ with } r = \begin{bmatrix}M_{CT}\\ q\end{bmatrix}$$

wherein

W is a suitable non-singular weighting matrix,

Θ is a vector of measurements containing response parameters, such as e.g. declinations/inclinations or strains/stresses or bending moments, A is a coefficient matrix relating $M_{CT}$ and q to the measured response, $M_{CT}$ is the bending moment of the tensioned elongated element, and q is the parameters describing the lateral load distribution on the wellhead element.

5. The method according to claim 1, further comprising:

measuring the top tension of the tensioned elongated element and the top angle of the tensioned elongated element, and estimating a vessel position that minimises the bending of the tensioned elongated element at the wellhead entry upon basis of the measured top tension and top angle in combination with the estimated bottom declination of the tensioned elongated element.

6. The method according to claim 1, wherein the measurement of the structural behaviour of the wellhead element comprises:

measuring the inclination, declination or bending moment of the wellhead element directly or indirectly.

7. The method according to claim 6, wherein the inclination/declination of the top end entry of the wellhead element is measured directly or derived from response measurements related to inclination/declination of the top end entry.

8. The method according to claim 1, further comprising:

measuring the top tension of the tensioned elongated element and estimating a vessel position that minimises the bending of the tensioned elongated element at the wellhead entry upon basis of the measured top tension in combination with the estimated bottom declination of the tensioned elongated element.

9. The method according to claim 8, wherein the estimation of the preferred vessel position relative to the present vessel position in a coordinate system with orthogonal horizontal axes X and Y is based on the following relation:

$$W\begin{bmatrix} \frac{K_T}{T_b} & 0 \\ 0 & -\frac{K_T}{T_b} \\ \frac{K_T}{T_t} & 0 \\ 0 & -\frac{K_T}{T_t} \end{bmatrix}\begin{bmatrix} x_e \\ y_e \end{bmatrix} = W\begin{bmatrix} \sin\alpha_{mb}^{zx} \\ \sin\alpha_{mb}^{zy} \\ \sin\alpha_{mt}^{zx} \\ \sin\alpha_{mt}^{zy} \end{bmatrix}$$

wherein

W is a suitable non-singular weighting matrix, $$K_T = \frac{1}{\int_0^L \frac{ds}{T(s)}}$$

and $$\sin\alpha_{mb}^{zx} \cong \sin\alpha_{mb}\cos(\beta_{mb} - \gamma_{mb}) = \frac{K_T}{T_b} = u_v \cdot \cos(\beta_{mb} - \gamma_{mb}) = \frac{K_T}{T_b}x_b$$

$$\sin\alpha_{mb}^{zy} \cong \sin\alpha_{mb}\sin(\beta_{mb} - \gamma_{mb}) = -\frac{K_T}{T_b}u_v \cdot \sin(\beta_{mb} - \gamma_{mb}) = -\frac{K_t}{T_b}y_b$$

$$\sin\alpha_{mt}^{zx} \cong \sin\alpha_{mt}\cos(\beta_{mt} - \gamma_{mt}) = \frac{K_T}{T_t}u_v \cdot \cos(\beta_{mt} - \gamma_{mt}) = \frac{K_T}{T_t}x_t$$

$$\sin\alpha_{mt}^{zy} \cong \sin\alpha_{mt}\sin(\beta_{mt} - \gamma_{mt}) = -\frac{K_T}{T_t}u_v \cdot \sin(\beta_{mt} - \gamma_{mt}) = -\frac{K_T}{T_t}y_t$$

where $x_b$, $y_b$, $x_t$, $y_t$ are the Cartesian coordinates of the offset estimates related to the simultaneously measured (directly or indirectly) lower and upper end declination respectively given in the suitable measurement interpretation coordinate systems, and given the constraint that:

$$x_e = w_{xb} \cdot x_b = w_{xt} \cdot x_t$$

$$y_e = w_{yb} \cdot y_b = w_{yt} \cdot y_t$$

where $w_{xb}$, $w_{yb}$, $w_{wy}$, $w_{yt}$ are weights related to the elements of the non-singular weighting matrix W.

10. A device for monitoring and/or controlling a load on a slender, tensioned elongated element extending from a subsea wellhead element to a surface vessel, by which the tensioned elongated element is arranged so as to be displaced in its longitudinal direction into or out of the subsea wellhead element via an entry at a top end of the latter, the device comprising:

means for measuring the structural behaviour of the wellhead element, and means for estimating the bending moment and/or declination of the tensioned elongated element in a bottom region adjacent to and/or at said entry upon basis of the measurement of the structural behaviour of the wellhead element.

11. The device according to claim 10, wherein the means for estimating the bending moment and/or declination of the tensioned elongated element in a bottom region adjacent to and/or at said entry upon basis of the measurement of the structural behaviour of the wellhead element comprises a computer program product with means for performing the estimation utilizing a method comprising measuring the structural behaviour of the wellhead element, and estimating the bending moment and/or declination of the tensioned elongated element in a bottom region adjacent to and/or at said entry upon basis of the measurement of the structural behaviour of the wellhead element.

12. The device according to claim 10, further comprisin:

means for estimating a vessel position that minimises the bending of the tensioned elongated element at the wellhead entry upon basis of the measured top tension and optionally top angle in combination with the estimated bottom declination of the tensioned elongated element.

13. The device according to claim 12, wherein the means for estimating the vessel position comprises a computer program product with means for performing the estimation according to a method comprising measuring the structural behaviour of the wellhead element, and estimating the bending moment and/or declination of the tensioned elongated element in a bottom region adjacent to and/or at said entry upon basis of the measurement of the structural behaviour of the wellhead element, measuring the top tension of the tensioned elongated element and estimating a vessel position that minimises the bending of the tensioned elongated element at the wellhead entry upon basis of the measured top tension in combination with the estimated bottom declination of the tensioned elongated element.

14. The device according to claim 10, further comprising:

first means for measuring the structural behaviour of the wellhead element, which first means comprises one or more inclinometers arranged on the wellhead element.

15. The device according to claim 14, wherein said first means is arranged at the upper part of the wellhead element.

16. The device according to claim 10, further comprising:

first means for measuring the structural behaviour of the wellhead element, which first means comprises one or more devices that measure strains, stresses and/or moments, such as one or more strain gauges arranged on the wellhead.

17. The device according to claim 16, wherein said first means are distributed around the circumference at one or more levels of the wellhead element.

18. The device according to claim 16, wherein said first means is arranged at the lower part of the wellhead element.

19. The device according to claim 10, further comprising:

second means for measuring the structural behaviour of the wellhead element, said second means being arranged at a different level on the wellhead element than said first means for measuring the structural behaviour of the wellhead element.

20. The device according to claim 19, wherein the second means for measuring the structural behaviour of the wellhead element comprises an inclinometer or a device that measures strains, stresses or moment.

21. The device according to claim 19, wherein said second means are distributed around the circumference at one or more levels of the wellhead element.

* * * * *